United States Patent [19]

Zinn

[11] Patent Number: 4,770,467

[45] Date of Patent: Sep. 13, 1988

[54] FOOTREST UNIT FOR WHEELCHAIRS

[75] Inventor: Eugene Zinn, West Hills, Calif.

[73] Assignee: Everest & Jennings, Inc., Camarillo, Calif.

[21] Appl. No.: 60,906

[22] Filed: Jun. 12, 1987

[51] Int. Cl.[4] ..... A47C 7/50

[52] U.S. Cl. ..... 297/429; 297/DIG. 4; 403/108

[58] Field of Search ..... 297/429, DIG. 4; 248/188.5; 403/108, 328, 327

[56] References Cited

U.S. PATENT DOCUMENTS

| | | | |
|---|---|---|---|
| 682,325 | 9/1901 | Garrett | 297/429 X |
| 2,520,309 | 8/1950 | Everest et al. | 297/433 |
| 2,598,985 | 6/1952 | Everest et al. | 297/433 |
| 2,601,889 | 7/1952 | Everest et al. | 297/433 |
| 2,675,057 | 4/1954 | Glass | 297/429 |
| 2,991,831 | 7/1961 | Jennings | 297/434 |
| 3,212,817 | 10/1965 | Sully | 297/429 |
| 3,301,595 | 1/1965 | Jennings | 297/437 |
| 3,376,067 | 4/1968 | Kernes | 297/429 X |
| 3,382,000 | 5/1968 | Sully | 297/422 |
| 3,857,606 | 12/1974 | Rodaway | 297/429 |
| 3,990,744 | 11/1976 | Rodaway | 297/433 |
| 4,176,879 | 12/1979 | Rodaway | 297/429 |
| 4,524,475 | 6/1985 | Valentino | 403/108 |

FOREIGN PATENT DOCUMENTS

| | | | |
|---|---|---|---|
| 1421660 | 11/1965 | France | 403/108 |
| 658490 | 10/1951 | United Kingdom | 403/108 |

*Primary Examiner*—James T. McCall

*Attorney, Agent, or Firm*—Kelly, Bauersfeld & Lowry

[57] ABSTRACT

An improved footrest unit is provided for use with a wheelchair or the like for supporting the foot and leg of a person using the wheelchair. The footrest unit includes an elongated leg tube having an upper end joined to an upper frame sleeve adapted for in-line rotatable connection between vertically aligned frame members of a wheelchair frame, and a lower end carrying a footplate for supporting the foot of a person using the wheelchair. The entire footrest unit is rotatable about a central axis of the frame sleeve and relative to the wheelchair frame for swinging movement between a normal operating position at the front of the wheelchair and an out-of-the-way position at one side of the wheelchair. Lock members are provided for releasably locking the footrest unit in the normal operating position. Two of the footrest units are normally provided for each wheelchair for respectively supporting both feet of a wheelchair user.

19 Claims, 3 Drawing Sheets

FIG. 1
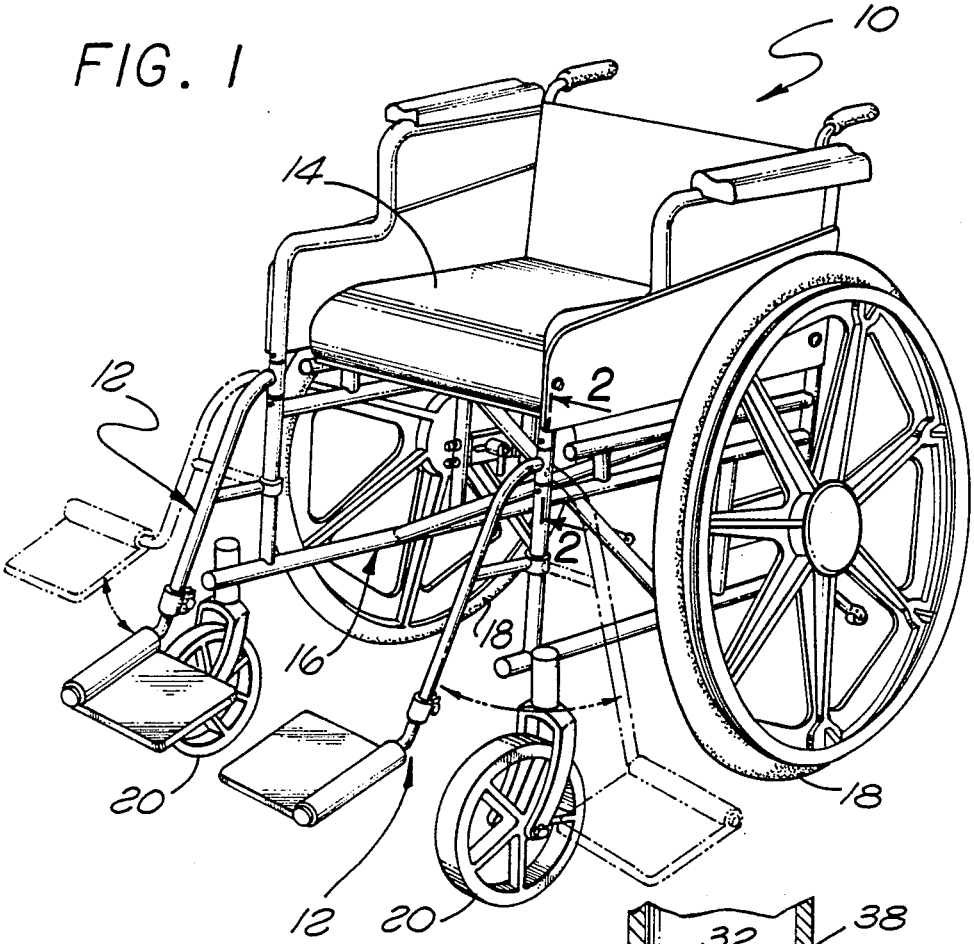
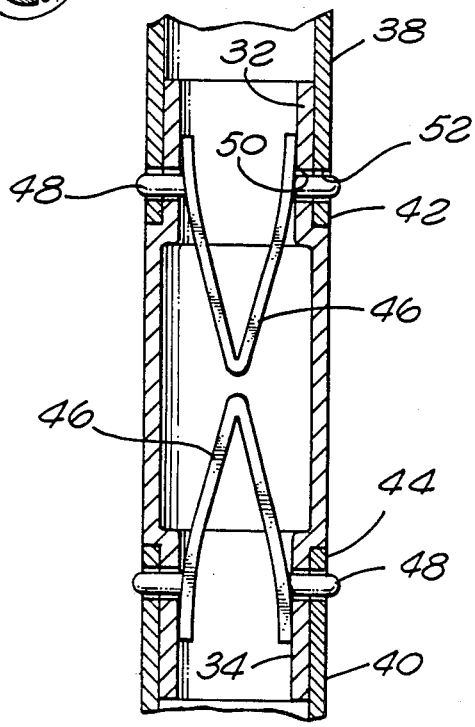
FIG. 2

FOOTREST UNIT FOR WHEELCHAIRS

BAGKGROUND OF THE INVENTION

This invention relates generally to an improved footrest unit designed for use with a wheelchair or the like. More particularly, this invention relates to a footrest unit of relatively simple and economical construction adapted for easy mounting onto a wheelchair and for relatively easy swinging movement to an out-of-the-way position, when desired.

Wheelchairs in general are well known in the art to include a plurality of interconnected frame components supporting a seat, with the frame components being supported in turn by a plurality of wheels for smooth rolling motion. In a typical wheelchair design, the frame components are constructed from tubular materials to provide a lightweight wheelchair construction which can be adapted, if desired, for folding movement to a compact, collapsed configuration for facilitated shipment, storage, or other transport. In most wheelchair designs, the frame-supporting wheels include a pair of relatively large rear wheels and a pair of comparatively smaller front caster wheels.

Many wheelchairs are further equipped with at least one and typically a pair of footrest units for supporting the feet and legs of a person using the wheelchair. Such footrest units are normally mounted onto wheelchair frame components at the front of the wheelchair and respectively include footplates for comfortably supporting a person's feet elevated above the floor or ground during wheelchair use. However, it is generally recognized that the footrest units at the front of the wheelchair present obstructions to patient movement into and from the wheelchair seat. Accordingly, it is desirable to construct the footrest unit for movement temporarily to an out-of-the-way position to avoid obstructing patient access to the wheelchair seat.

In this regard, many prior footrest units have been designed for removal from the wheelchair during patient movement to or from the seat, after which the footrest units are reattached to the wheelchair in positions for normal use. However, it is frequently difficult for the person using the wheelchair to reattach the footrest units without assistance. Moreover, such removal of the footrest units subjects the footrest units to occasional misplacement. Alternate footrest unit designs have utilized rotatable mounting structures for swinging all or part of the footrest unit temporarily the out-of-the-way position, in combination with latch or locking components for releasably retaining the footrest unit in a normal operational position at the front of the wheelchair. These swinging structures, however, normally require a variety of supporting and locking components, some of which must be permanently attached to the wheelchair frame, resulting in a footrest unit which tends to be complex and costly to manufacture.

There exists, therefore, a significant need for an improved footrest unit for use with a wheelchair, wherein the footrest unit has a simplified and economical design adapted for easy mounting onto a wheelchair frame and for facilitated swinging movement between normal operating and out-of-the-way positions. The present invention fulfills these needs and provides further related advantages.

SUMMARY OF THE INVENTION

In accordance with the invention, an improved footrest unit of simplified design is provided for mounting onto the frame of a wheelchair or the like. The footrest unit includes means for releasably locking the footrest unit in a normal operating position at the front of the wheelchair for supporting the foot and leg of a person using the wheelchair. The locking means is easily released when desired to permit swinging movement of the footrest to an out-of-the-way position at one side of the wheelchair for unobstructed access to the wheelchair seat during movement of a person to or from the seat.

In the preferred form, the improved footrest unit comprises an elongated leg tube joined at an upper end thereof to a cylindrical frame sleeve adapted for connection to the wheelchair frame, and carrying a footplate at its lower end. The frame sleeve is designed for in-line rotatable connection between a vertically aligned pair of frame members forming part of the wheelchair frame. Locking means such as a spring loaded clip or pin or the like interacts between the frame sleeve and at least one of the wheelchair frame members to releasably lock the frame sleeve against rotation, with the leg tube projecting downwardly and forwardly therefrom in the normal operating position generally at the front of the wheelchair. For added stability, an auxiliary support tube is joined to the leg tube at a position below the upper frame sleeve and terminates in a clamp member adapted for rotatable reception about the lower wheelchair frame member at a position below the frame sleeve.

The locking means releasably retains the footrest unit in the normal operating position at the front of the wheelchair, wherein the footplate is disposed for comfortably supporting the foot and leg of a person using the wheelchair. When desired, the locking means is easily released to permit rotation of the footrest unit about the vertically oriented central axis of the frame sleeve, and in a laterally outboard direction to swing the leg tube and footplate to the out-of-the-way position. The leg tube and footplate are easily returned when required to the front of the wheelchair for normal use, with the locking means preferrably self-locking to relock the footrest unit in place.

In accordance with one aspect of the invention, the wheelchair frame member positioned above the footrest unit frame sleeve may comprise the downturned front end of an elongated tube forming the structural support member of a side skirt unit for the wheelchair. This side skirt unit is removably mounted onto the wheelchair by means of its connection to the frame sleeve and conveniently supports an armrest and/or an enclosing side skirt at one side of the wheelchair seat.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating a wheelchair including a pair of improved footrest units embodying the novel features of the invention;

FIG. 2 is an enlarged fragmented vertical sectional view taken generally on the line 2—2 of FIG. 1;

DETAILED DESCRIPTION OF THE PREFERRED EMBODIMENTS

Figures 3, 4:
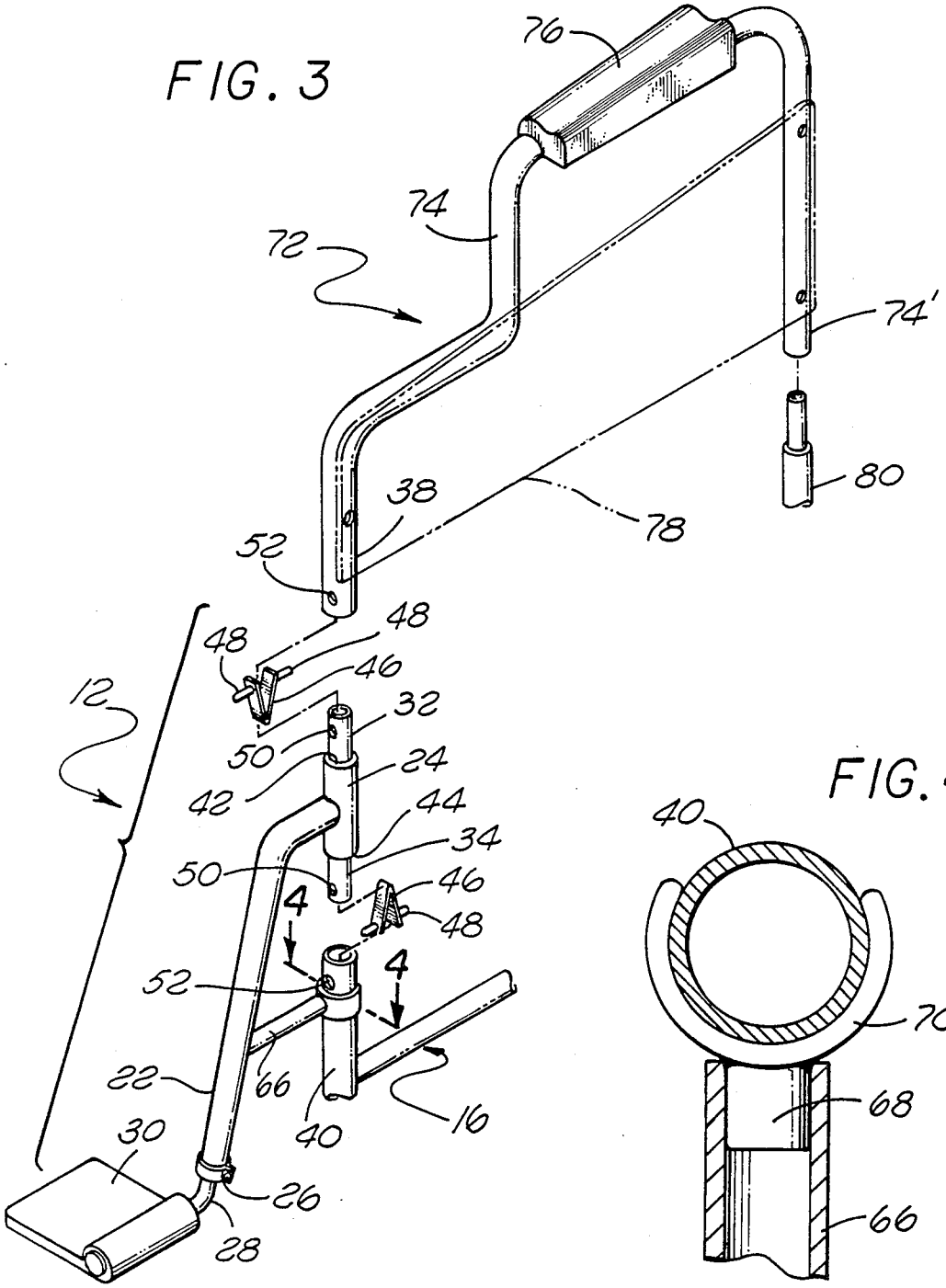
FIG. 3 is an enlarged fragmented exploded perspective view showing the construction of one of the improved footrest units and mounting thereof onto the wheelchair.
FIG. 4 is an enlarged horizontal sectional view taken generally on the line 4—4 of FIG. 3.

As shown in the exemplary drawings, a wheelchair or the like is referred to generally in FIG. 1 by the reference numeral 10. The wheelchair 10 is equipped with a pair of improved footrest units 12, formed in accordance with the invention, for use in supporting the legs and feet of a person using the wheelchair. These footrest units 12 are adapted for rapid and simple swinging movement between normal operating positions at the front of the wheelchair as viewed in solid lines in FIG. 1, and out-of-the-way positions as shown in dotted lines in FIG. 1.

As shown generally in FIG. 1, the improved footrest units 12 of the present invention are adapted for use with a generally conventional wheelchair 10 having a seat 14 supported by a wheelchair frame 16 formed typically from relatively lightweight tubular frame components of metal tubing or the like. The wheelchair frame 16 is supported in turn for smooth rolling motion by means of a pair of relatively large rear wheels 18 mounted on opposite sides of the frame 16 generally at the rear thereof, and a corresponding pair of comparatively smaller diameter caster wheels 20 mounted on opposite sides of the wheelchair frame at the lower front thereof. The footrest units 12 are normally provided in pairs and are mounted respectively onto opposite sides of the wheelchair frame 16 for respectively supporting the right and left feet and legs of a person using the wheelchair. Alternately, a single footrest unit 12 can be mounted on the wheelchair 10 in accordance with the specific needs of the person using the wheelchair.

In general terms, the footrest units 12 are normally positioned at the front of the wheelchair 10 for comfortably supporting a person's feet and legs elevated slightly above the floor or ground during normal rolling wheelchair motion. However, to facilitate patient entry into and exit from the wheelchair seat 14, the footrest units 12 can be moved quickly and easily with a simple swinging motion to the out-of-the-way positions at laterally outboard sides of the wheelchair. In accordance with the invention, the improved footrest units are mounted on the wheelchair to accommodate this desired positional adjustment without requiring complex mechanical arrangements or permanent attachment of rotating or latching components to the wheelchair frame.

One of the improved footrest units 12 is shown in detail in FIGS. 2-4, it being understood that the two footrest units shown in FIG. 1 are generally identical and can be mounted interchangeably onto the wheelchair frame 16 at the right or left side of the wheelchair. More particularly, the illustrative footrest unit 12 comprises an elongated leg tube 22 formed from metal tubing or the like having an upper end joined to a generally vertically oriented short frame sleeve 24. From the sleeve 24, the leg tube 22 is shaped to extend generally horizontally a short distance and then to turn generally downwardly and angularly away from the frame sleeve 24 to terminate with a lower end clamp 26. A footplate support rod 28 is telescopically received into the lower end of the leg tube 22 and projects downwardly therefrom a short distance before turning generally horizontally in a direction away from the upper frame sleeve 24. A footplate 30 is carried by the support rod 28 to extend generally laterally therefrom for use in supporting a person's foot and leg, as will be described. The connection between the support rod 28 and the footplate 30 may take various forms, with a pivoting connection of the type described in U.S. Pat. No. 3,990,744 being preferred. Conveniently, when the footrest unit 12 is mounted on the wheelchair, the height of the footplate 30 is adjustable upon appropriate loosening of the clamp 26 to permit longitudinal adjustment of the support rod 28 within the leg tube 22.

The upper frame sleeve 24 of the footrest unit 12 is also formed from metal tubing or the like and includes upper and lower cylindrical connectors 32 and 34 of slightly reduced diameter relative to a central region thereof. These upper and lower connectors 32 and 34 are sized for relatively close sliding reception respectively into vertically aligned and spaced apart open ends of upper and lower frame members 38 and 40 extending generally on a common vertical axis at or near the front of the wheelchair. The open ends of these frame members 38 and 40 define sockets for receiving the frame sleeve connectors 32 and 34 such that the frame members abut shoulders 42 and 44 at the axially opposite ends of the central region of the frame sleeve. With this construction, the frame sleeve 24 of the footrest unit 12 is generally vertically oriented and supported at the front of the wheelchair within the aligned frame members 38 and 40 for free rotation about a vertical central axis of the frame sleeve. Accordingly, the frame sleeve 24 supports the leg tube 22 and footplate 30 thereon for swinging movement between the normal operating position at the front of the wheelchair and the out-of-the-way position displaced in a laterally outboard direction relative to the wheelchair.

The footrest unit 12 is locked in the normal operating position in a simple and easily released manner by locking means releasably engaged between the frame sleeve 24 and at least one of the aligned frame members 38 and 40. As shown in FIG. 3, this locking means comprises a pair of spring loaded locking clips 46 of V-shaped or other suitable construction received into the hollow interior of the frame sleeve 24 respectively within the upper and lower connectors 32 and 34. The clips 46 include outwardly projecting lock buttons 48 which are spring loaded for normal protrusion outwardly through fore and aft ports 50 formed in the connectors 32 and 34. When these buttons 48 are aligned with similar fore and aft ports 52 formed in the associated frame members 38 and 40, the buttons 48 project also through those ports 52 to lock the frame sleeve 24 against rotation with the footrest unit in the normal operating position at the front of the wheelchair. However, when it is desired to swing the footrest unit 12 to the alternative out-of-the-way position, the buttons 48 are easily depressed sufficiently to release from the frame members 38 and 40 to permit the desired swinging movement in the outboard direction. Return swinging movement to the normal position conveniently results in self-locking by the buttons which are spring loaded by the clips for automatic return into the frame members ports 52 when the buttons are realigned therewith.

Figure 5:
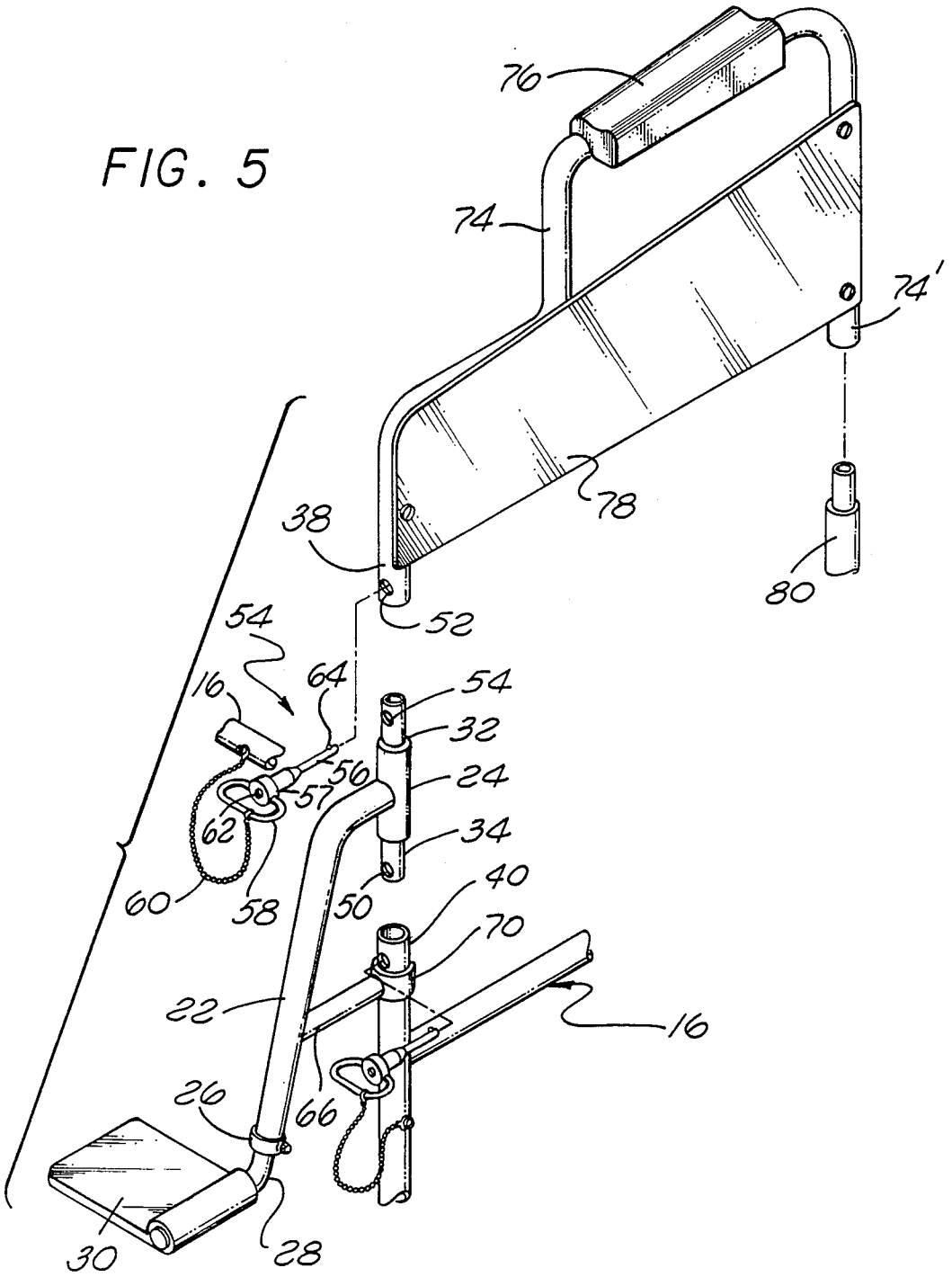
FIG. 5 is an enlarged fragmented exploded perspective view similar to FIG. 3 but depicting one alternative form of the invention.

In an alternative preferred form of the invention, as viewed in FIG. 5, the spring loaded clips 46 can be replaced by alternative locking means such as locking pins 54 having elongated shanks 56 sized for sliding reception through the connector and frame member ports 50 and 52 when those ports are aligned with the footrest unit 12 in the normal operating position. In this version, the locking pins 54 are shown to include enlarged heads 57 carried by support rings 58 each secured in turn by a chain 60 or the like to a selected position on the wheelchair frame 16 to prevent loss. An actuator button 62 on the head 57 of each locking pin is depressable manually to operate an internal mechanism of the type known in the art for retracting outwardly protruding lock balls 64 at the distal end of the pin shank 56 to permit pin insertion into or withdrawal from the aligned ports 50 and 52.

Irrespective of the particular locking means used, the structural load supporting capacity of the footrest unit 12 by providing an auxiliary support tube 66 extending between the leg tube 22 and the lower frame member 40 of the wheelchair frame 16, at a position below the frame sleeve 24. More particularly, the auxiliary support tube 66 has a forward end joined by welding or the like to the leg tube 22 and extends rearwardly. The rear end of the support tube 66 terminates in an open end receiving the base 68 of a clamp member 70 (FIG. 4) such as a generally U-shaped rearwardly open clamp of molded plastic or the like. This clamp member 70 reacts between the frame member 40 and the leg tube 22 when subjected to a vertical load, particularly such as the weight of a person's foot and leg rested upon the footplate 30. Importantly, however, the clamp member 70 is vertically aligned with the frame sleeve 24 and accommodated footrest unit swinging motion between the normal operating and the out-the-way positions.

In accordance with further aspects of the invention, the improved footrest unit 12 cooperates with the wheelchair frame members 38 and 40 to provide a simple mounting arrangement for a side skirt unit 72, as shown in FIGS. 3 and 5. More particularly, the upper frame member 38 comprises the downturned forward end of an elongated tube 74 forming the structural support member of the side skirt unit 72 and shaped to carry an armrest 76 at one side of the wheelchair seat. An enclosing side panel 78 may also be mounted on the tube 74, if desired. The tube 74 includes a downturned rear end 74' adapted for sliding fit onto an upright post 80 at the rear of the wheelchair frame 16, with a locking member being conveniently connected therebetween (not shown), if desired.

Accordingly, the improved footrest unit 12 of the present invention provides a relatively simple construction designed for easy mounting onto a wheelchair, without requiring the use of complicated latch or footrest support arrangements, and further without requiring permanent mounting of any latch or other support components or portion thereof onto the wheelchair frame.

A variety of modifications and improvements to the improved footrest unit of the invention will be apparent to those skilled in the art. Accordingly, no limitation on the invention is intended by way of the description herein and the accompanying drawings, except by way of the appended claims.

What is claimed is:

1. A footrest unit for use with a wheelchair having a pair of generally aligned and spaced apart frame members defining a generally upright frame axis, said footrest unit comprising:

an elongated leg tube having upper and lower ends;

a frame sleeve connected to said leg tube generally at the upper end thereof, said frame sleeve being adapted for rotatable in-line connection between said aligned frame members of said wheelchair; and a footplate carried by said leg tube generally at the lower end thereof, said leg tube and said footplate being swingable together about the frame axis between a normal operating position for supporting the foot and leg of a person using the wheelchair, and an out-of-the-way position.

2. The footrest unit of claim 1 further including locking means for releasably locking said footrest unit in said normal operating position.

3. The footrest unit of claim 2 wherein said locking means is spring loaded for self locking upon swinging movement of said footrest unit to said normal operating position.

4. The footrest unit of claim 1 wherein said frame sleeve and at least one of said frame members includes ports therein in alignment with each other when said footrest unit is in said normal operating position, said locking means including means for reception through said ports for releasably locking said footrest unit in said normal operating position.

5. The footrest unit of claim 4 wherein said means for reception through said ports comprises a spring loaded button within said frame sleeve.

6. The footrest unit of claim 4 wherein said means for reception through said ports comprises a lock pin and chain means for mounting said lock pin onto said wheelchair.

7. The footrest unit of claim 1 wherein said frame members define an aligned pair of open sockets, said frame sleeve including means for sliding reception into said open sockets.

8. The footrest unit of claim 1 wherein said frame members include vertically aligned upper and lower frame members, said upper frame member comprising a support component of a side skirt unit for the wheelchair.

9. The footrest unit of claim 8 further including an armrest on said support component.

10. A footrest unit for use with a wheelchair having a pair of generally vertically aligned upper and lower, spaced apart frame members, said footrest unit comprising:

an elongated leg tube;

a frame sleeve connected to said leg tube generally at one end thereof, said frame sleeve being adapted for rotatable connection between said aligned frame members of said wheelchair;

a footplate carried by said leg tube generally at the opposite end thereof, said leg tube and said footplate being swingable together between a normal operating positions for supporting the foot and leg of a person using the wheelchair, and an out-of-the-way position; and further including an auxiliary support tube extending between said leg tube at a position generally intermediate the length thereof and said lower frame member.

11. The footrest unit of claim 10 wherein said auxiliary support tube includes a clamp member rotatably carried about said lower frame member.

12. A footrest unit for use with a wheelchair having a generally vertically aligned upper and lower frame members, said footrest unit comprising:

an elongated leg tube;

a frame sleeve connected to said leg tube generally at one end thereof, said frame sleeve being adapted for rotatable connection between said aligned upper and lower frame members;

a footplate carried by said leg tube generally at the lower end thereof;

an auxiliary support tube connected to said leg tube at a position generally intermediate the length thereof and extending between said leg tube and said lower frame member when said frame sleeve is connected between said frame members;

a clamp member carried by said auxiliary support tube and rotatably receivable about said lower frame member when said frame sleeve is connected between said frame members;

said leg tube and footplate being swingable together relative to said frame members between a normal operating position for supporting the leg and foot of a person using the wheelchair and an out-of-the-way position; and locking means for releasable locking the footrest unit in the normal operating position.

13. The footrest unit of claim 12 wherein said locking means is spring loaded for self locking upon swinging motion of the footrest to said normal operating position.

14. The footrest unit of claim 12 wherein said frame members and said frame sleeve include ports therein positioned for alignment with each other when the footrest is in the normal operating position, said locking means including spring loaded buttons for reception through said ports when aligned with each other for locking the footrest unit in the normal operating position.

15. The footrest unit of claim 12 wherein said frame members and said frame sleeve include ports therein positioned for alignment with each other when the footrest is in the normal operating position, said locking means including a lock pin for reception through said ports for locking the footrest in the normal operating position.

16. The footrest unit of claim 12 wherein said upper frame member comprises a support component for a side skirt unit for the wheelchair.

17. The footrest unit of claim 12 further including means for adjusting the height of said footplate.

18. A wheelchair, comprising:

a wheelchair frame having a front end including a pair of vertically aligned and spaced apart frame members defining a generally upright frame axis;

wheel means on said frame for supporting said frame for rolling movement;

a seat supported by said frame; and at least one footrest unit including a leg tube, a frame sleeve on said leg tube and including means for mounting said frame sleeve in-line and rotatably between said frame members, and a footplate carried by said leg tube, said footrest unit being swingable about said frame axis between a normal operating position at the front of the wheelchair frame for supporting the foot of a person using the wheelchair and a laterally outboard out-of-the-way position.

19. The wheelchair of claim 18 wherein said footrest further includes locking means for releasably locking said footrest unit in the normal operating position.

* * * * *